US008272849B1

(12) United States Patent
Stein

(10) Patent No.: US 8,272,849 B1
(45) Date of Patent: Sep. 25, 2012

(54) PROCESS FOR SIZING A THROAT LENGTH OF A JET PUMP

(75) Inventor: Elizabeth V Stein, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 418 days.

(21) Appl. No.: 12/571,571

(22) Filed: Oct. 1, 2009

(51) Int. Cl.
*F04B 49/00* (2006.01)

(52) U.S. Cl. ..... 417/296

(58) Field of Classification Search ..... 417/53, 417/151, 178, 196; 29/888.02
See application file for complete search history.

(56) References Cited

U.S. PATENT DOCUMENTS 3,371,618 A * 3/1968 Chambers ..... 417/163
4,931,225 A * 6/1990 Cheng ..... 261/76

* cited by examiner

*Primary Examiner* — Charles Freay
*Assistant Examiner* — Ryan Gatzemeyer
(74) *Attorney, Agent, or Firm* — John Ryznic

(57) ABSTRACT

A process for sizing an axial length of a throat in a jet pump, where an exponential relationship between mixing and kinetic energy dissipation of the primary jet is plotted in terms of a non-dimensional parameter on a graph which ranges from around 1.0 at an axial length of zero to a ratio of less than 0.1 at the minimal axial length of the throat to produce complete mixing between the primary and secondary fluids. This non-dimensional parameter is referred to as the Stein number.

2 Claims, 2 Drawing Sheets

$$Stein\# = \frac{(V\max_axial_location - Varea_avg_location)}{(Vmass_avg_primary_inlet - Vmass_avg_secondary_inlet)}$$

$$Stein\# = \frac{(V\max_axial_location - Varea_avg_location)}{(Vmass_avg_primary_inlet - Vmass_avg_secondary_inlet)}$$

Stein# vs. axial throat distance

PROCESS FOR SIZING A THROAT LENGTH OF A JET PUMP

GOVERNMENT LICENSE RIGHTS

None

CROSS-REFERENCE TO RELATED APPLICATIONS

None

BACKGROUND OF THE INVENTION

1. Field of the Invention

The present invention relates generally to a jet pump, and more specifically to a process for optimally sizing the length of a constant area throat of a jet pump.

2. Description of the Related Art Including Information Disclosed Under 37 CFR 1.97 and 1.98

Jet (or ejector) type pumps are commonly used in many applications, including water pumps, industrial chemical pumps, sewage pumps, etc. FIG. 1 illustrates a common jet pump configuration. The benefit of a jet pump is the increased reliability through lack of rotating machinery. This also makes them ideal for applications where fluid with solid particles is being pumped.

The performance of the jet pump comes from the way the fluid pressure is increased—a jet of higher momentum fluid is used to "drive" the pump. That is, the higher momentum jet mixes with the lower momentum fluid to be pumped in the constant area throat, imparting its work on the fluid in that manner. Then the total pressure of the mixed flow is recovered into an overall static pressure rise through the diffuser.

In order to recover the maximum amount of pressure from the diffuser, a high divergence angle is necessary. For high divergence angle diffusers to work optimally, the mixing of the driving (primary/high pressure) and driven (secondary/low pressure) flows has to be complete by the exit of the constant area throat in order to avoid separation in the diffuser.

For low area ratio (primary nozzle area/throat area) jet pumps, there is an efficiency limit based on how much surface area the high energy jet has to mix with the low head fluid. The potential core is the region of essentially uniform velocity on a jet, which is circumferentially surrounded by the shear mixing layer. See FIG. 2 for an illustration of jet potential core flow. For conventional jet pumps, there are several rule-of-thumb guidelines for how long to make the constant area throat, with lengths anywhere from 3-9 times the diameter of throat being recommended. However, the longer the throat length, the more wall friction losses are encountered. Therefore, a designer wants to make the throat just long enough to complete mixing but no longer due to the wall friction losses.

BRIEF SUMMARY OF THE INVENTION

It is an object of the present invention to provide for a jet pump with an optimally sized length of a constant area throat.

It is another object of the present invention to provide for a jet pump in which mixing of the primary and secondary streams has been completed by the throat exit.

The above objective and more are achieved with the process for sizing the length of a constant area throat in the jet pump by solving an equation (referred to herein as the Stein number) at various axial locations along the throat, plotting the Stein number vs. axial length (which generally shows an exponential relationship between mixing and kinetic energy dissipation of the primary jet), and then determining the minimal axial length of the throat in which the Stein number is less than 0.1 in ratio. The process of the present invention can also be used to size a throat in a non-conventional jet pump configuration such as an annular primary nozzle.

The Stein number is a ratio of a difference between the maximum velocity at a given axial location minus the area averaged velocity at that same axial location divided by the difference between the mass averaged velocity at the primary inlet minus the mass averaged velocity at the secondary inlet. This ratio will decrease from just under one at an axial length of 0 to under 0.1 when the axial length is just enough to produce when mixing between the primary and secondary flows has been completed.

DETAILED DESCRIPTION OF THE INVENTION

Figures 1, 2:
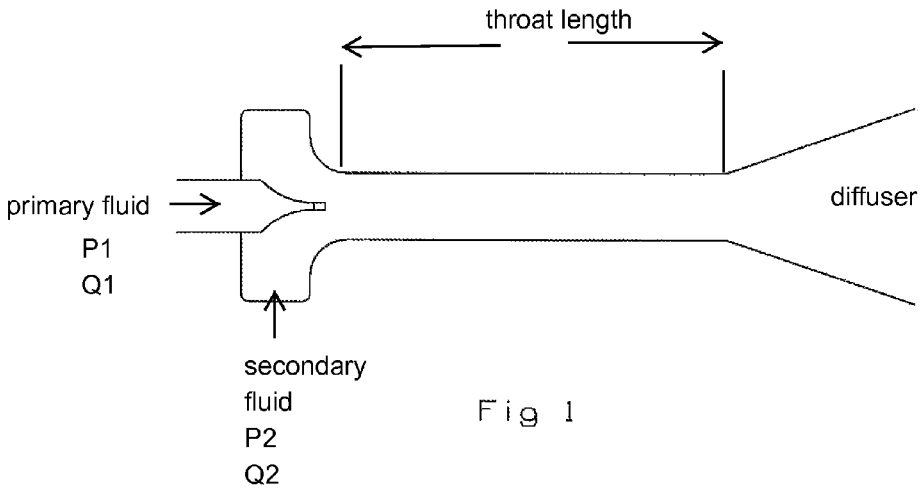
FIG. 1 shows a cross section view of a jet pump.
FIG. 2 shows the Stein number used to solve for the axial length of the throat in the jet pump of FIG. 1.

The present invention is a quantitative way to determine when mixing has been completed between the primary and secondary streams of a jet pump in order to optimally size the length of a constant area throat of a jet pump. A jet pump includes a primary nozzle to inject a primary fluid, a secondary fluid inlet, a throat downstream from the inlets for the two fluids, and a diffuser located immediately downstream from the throat as seen in FIG. 1. A transition is formed between the secondary fluid inlet section and the throat. The throat has an axial length that must be sized to produce complete mixing of the primary and secondary fluids before entering the diffuser.

The Stein number is a non-dimensional parameter to quantify degree of mixing between the primary and secondary flows. The concept is similar to the temperature pattern factor used in turbine design, however instead of a radial temperature profile, the Stein number is determined using a radial velocity profile at selected axial locations. The Stein number is defined as ratio of a difference between the maximum velocity at a given axial location minus the area averaged velocity at that same axial location divided by the difference between the mass averaged velocity at the primary inlet minus the mass averaged velocity at the secondary inlet, and is shown in FIG. 2.

Figure 3:
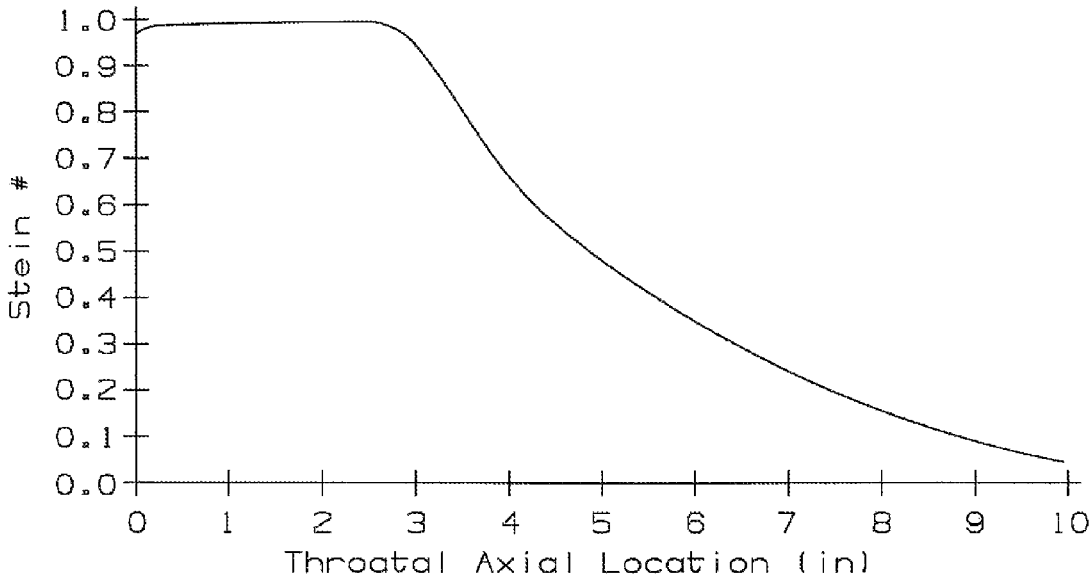
FIG. 3 shows a graph of the Stein number for a range of axial lengths from zero to the desired axial length that produces complete mixing between the primary and secondary flows of the jet pump of FIG. 1.

The process for using the Stein number in a jet pump design involves the following steps. The Stein number is computed at various axial locations along the throat and plotted on a graph with the Stein number on the vertical axis and the axial throat length on the horizontal axis. This plot will show a generally exponential relationship between mixing and kinetic energy dissipation of the primary jet. A Stein number of less than 0.1 for a conventional jet pump corresponds best to test data for the location within the throat of complete mixing between the primary and secondary flows. A Stein number of less than 0.1 can be used to size the throat axial length. Thus, an axial length of the throat in a jet pump will be the axial length shown on the graph of FIG. 3 in which the plot drops just below the 0.1 ratio.

I claim:

1. A process for sizing an axial throat length of a jet pump comprising the steps of:

computing a Stein number at various axial locations along the throat of the jet pump;

plotting an exponential relationship between mixing and kinetic energy dissipation of a primary jet;

determining from the exponential relationship at which axial location the Stein number becomes less than 0.1; and, sizing the axial length of the throat in which the Stein number is less than 0.1.

2. The process for sizing an axial throat length of a jet pump of claim 1, wherein the Stein number is the ratio between the maximum velocity at a given axial location minus the area averaged velocity at the same axial location and the mass averaged velocity at the primary inlet minus the mass averaged velocity at the secondary inlet.

* * * * *